US007269980B2

(12) United States Patent
Kim et al.

(10) Patent No.: US 7,269,980 B2
(45) Date of Patent: Sep. 18, 2007

(54) TUB PROTECTION BOLT OF WASHING MACHINE

(75) Inventors: Gon Kim, Jinhae-si (KR); Yu Beom Kang, Changwon-si (KR); Sang Man Je, Koje-si (KR)

(73) Assignee: LG Electronics Inc., Seoul (KR)

( * ) Notice: Subject to any disclaimer, the term of this patent is extended or adjusted under 35 U.S.C. 154(b) by 242 days.

(21) Appl. No.: 10/718,618

(22) Filed: Nov. 24, 2003

(65) Prior Publication Data

US 2004/0118167 A1 Jun. 24, 2004

(30) Foreign Application Priority Data

Nov. 28, 2002 (KR) ..... 10-2002-0075017

(51) Int. Cl.
*D06F 37/00* (2006.01)

(52) U.S. Cl. ..... 68/3 R

(58) Field of Classification Search ..... 68/3 R; 411/221, 216, 187, 378, 402; 403/408.1
See application file for complete search history.

(56) References Cited

U.S. PATENT DOCUMENTS 258,061 A * 5/1882 Haviland ..... 256/53
3,032,291 A * 5/1962 Kendt et al. ..... 242/376
3,489,866 A * 1/1970 Tamarin ..... 191/12.2 R
4,624,117 A * 11/1986 Ory et al. ..... 68/3 R
5,072,473 A * 12/1991 Thuruta et al. ..... 8/159
5,806,452 A * 9/1998 Benoit ..... 114/218
2002/0049446 A1* 4/2002 Harkey et al. ..... 606/70
2004/0037640 A1* 2/2004 Kim et al. ..... 403/408.1

FOREIGN PATENT DOCUMENTS

DE 19651292 A1 * 6/1998
JP 2000139018 A * 5/2000
WO WO 200244458 A1 * 6/2002

* cited by examiner

*Primary Examiner*—Michael Barr
*Assistant Examiner*—Sarah E. Husband
(74) *Attorney, Agent, or Firm*—Ked & Associates, LLP

(57) ABSTRACT

A tub protection bolt for a washing machine is disclosed for fixing a tub to a cabinet for the washing machine. The tub protection bolt includes a screwed shaft configured to penetrate a cabinet of the washing machine to be coupled with a boss of a tub and a head part at one end of the screwed shaft having a narrow cut-away portion configured to hold a power cable of the washing machine. The head part includes a head at the one end of the screwed shaft, a flange extending outward from an outer circumference of the head, and the narrow cut-away portion provided from an outer circumference of the flange toward the head. The cut-away portion includes an insertion portion provided from the outer circumference of the flange in a direction of a center of the head and a fixing portion bent from an end of the insertion portion.

16 Claims, 4 Drawing Sheets

TUB PROTECTION BOLT OF WASHING MACHINE

BACKGROUND OF THE INVENTION

This application claims the benefit of Korean Application No. P2002-75017 filed on Nov. 28, 2002, which is hereby incorporated by reference.

1. Field of the Invention

The present invention relates to a washing machine, and more particularly, to a tub protection bolt of a washing machine for fixing a tub to a cabinet on carrying the washing machine.

2. Discussion of the Related Art

Generally, a washing machine is an apparatus for eliminating dirt or filth attached to a laundry using reaction between water and detergent.

Such a washing machine is classified as a pulsator type, an agitator type, or a drum type. The agitator type washing machine rotates an agitator protruding from a bottom center of a tub in forward and reverse directions to perform washing. The pulsator type washing machine rotates a disc-type pulsator on a bottom of a tub in forward and reverse directions to perform washing using a frictional force between a generated current and a laundry. The drum type washing machine rotates a drum holding water, detergent, and laundry at low speed to perform washing. In this case, a plurality of tumbling ribs protrude from an inside of the tub.

In the various kinds of the washing machines, numerous vibrations are applied to a tub holding water on operating the washing machine. A spring and a damper are provided between the tub and cabinet to prevent the tub from being broken by the vibrations.

A washing machine that is being carried receives numerous vibrations as well. Hence, the tub severely vibrates on passage so that the tub, damper, a motor connected to the tub, and various other parts are occasionally broken.

Recently, in order to prevent the tub from shaking, a protection screw is coupled with an outside of the cabinet to fix the tub.

Yet, the protection screw should be separated to use the washing machine after the washing machine has been installed. If the washing machine is driven without unscrewing the protection screw, the tub fixed by the protection screw may be broken by the vibrations generated from driving the washing machine.

However, a user may forget to unscrew the protection screw and then uses the washing machine, whereby the tub is occasionally broken. Hence, a structural improvement for preventing the washing machine from operating while the tub is fixed by the protection screw is needed.

SUMMARY OF THE INVENTION

Accordingly, the present invention is directed to a tub protection bolt of a washing machine that substantially obviates one or more of the problems due to limitations and disadvantages of the related art.

An object of the present invention, which has been devised to solve the foregoing problem, lies in providing a tub protection bolt of a washing machine, by which a power cable is held so that the power cable is unable to be connected to an electric outlet while the protection bolt is unscrewed.

It is another object of the present invention to provide a tub protection bolt of a washing machine, which implements a structure enabling to prevent the tub from being broken on operating the washing machine while a tub is fixed by the protection bolt.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a tub protection bolt of a washing machine including a screwed shaft penetrating a cabinet of the washing machine to be coupled with a boss of a tub and a head part at one end of the screwed shaft to have a narrow cut-away portion holding a power cable of the washing machine by insertion.

In another aspect of the present invention, there is provided a washing machine including a cabinet, a tub in the cabinet to have at least one boss protruding from an outside of the tube, the protection bolt, an elastic members suspending the tub in the cabinet, and a drum rotatably installed in the tub.

Meanwhile, in the present invention, the head part may include a head at the one end of the screwed shaft, a flange extending outward from an outer circumference of the head, and the narrow cut-away portion provided from an outer circumference of the flange toward the head.

And, the cut-away portion may include an insertion portion provided from the outer circumference of the flange in a direction of a center of the head and a fixing portion bent from an end of the insertion portion.

In this case, an outer circumference side of the flange contouring the insertion portion is preferably wider than an opposite side. And, an outside corner of the flange meeting the insertion portion is preferably rounded.

And, the fixing portion may be formed rounded along a direction of rotating the head part when the screwed shaft is screwed or unscrewed. Moreover, the fixing portion is preferably formed along a direction that the power cable inserted in the fixing portion naturally moves toward the insertion portion when the head rotates in one direction, and more specifically, in a direction of unscrewing the screwed shaft.

Meanwhile, the tub protection bolt may further include a washer provided between the head part and the cabinet to have a predetermined thickness. And, the power cable may include a protrusion extending an outer circumference of the power cable to lie between the head part and the cabinet when the power cable is inserted in the cut-away portion.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
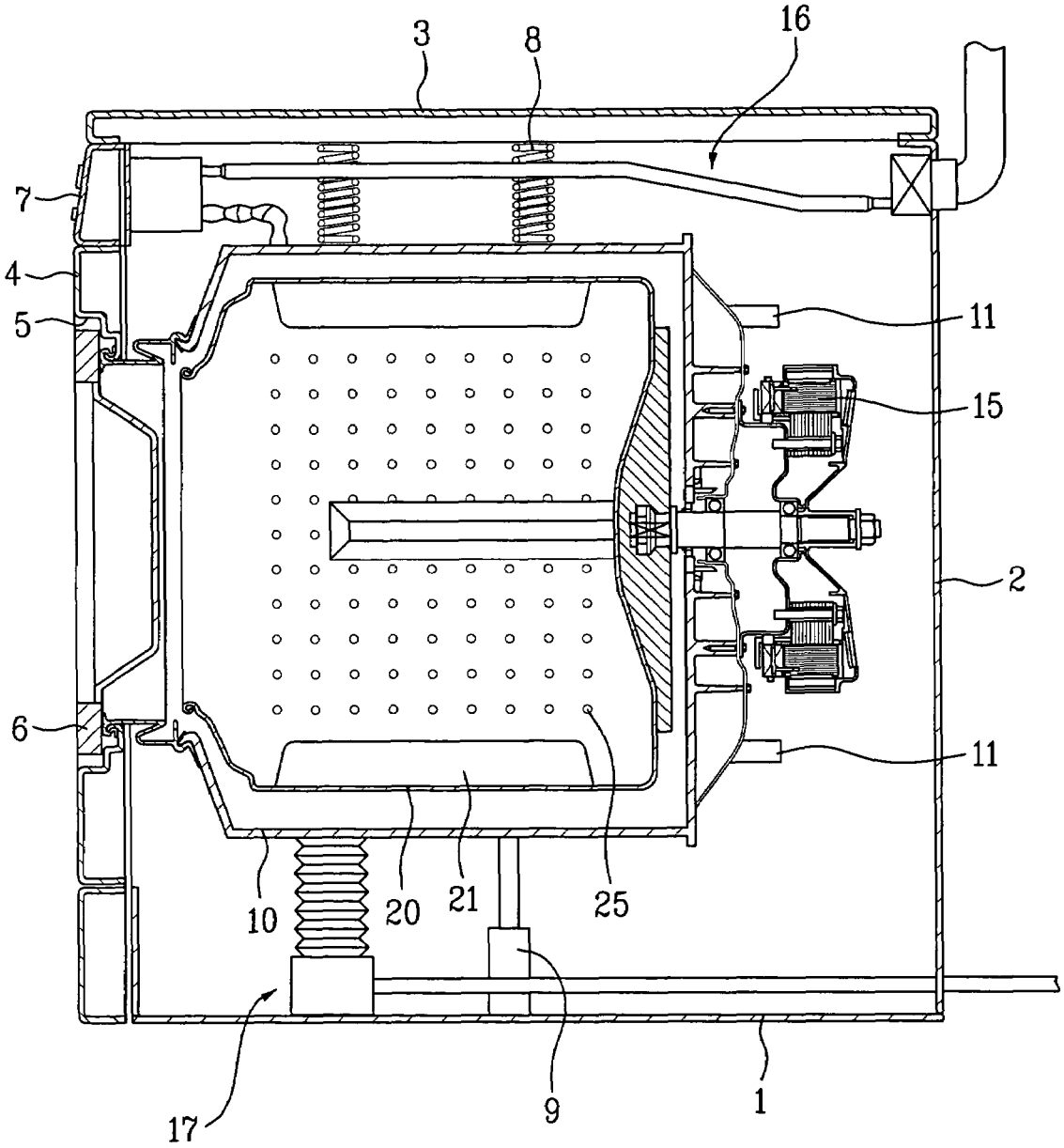
FIG. 1 is a cross-sectional view of a washing machine according to one embodiment of the present invention.

FIG. 1 is a cross-sectional view of a washing machine according to one embodiment of the present invention, in which a drum type washing machine is shown. Yet, the present invention is applicable to any other kinds of washing machines such as agitator type, pulsator type, and the like.

Referring to FIG. 1, a cabinet 2 is vertically set up on a base panel 1 forming a bottom of a washing machine. The cabinet 2 forms sidewalls and a rear wall of the washing machine. A cabinet cover 4 is provided on an open front side of the cabinet 2, and a top plate 3 is provided on an open topside of the cabinet 2.

A tub 10 is provided in the cabinet 2. The tub 10 is arranged to be suspended in the cabinet 2. For this, a plurality of elastic members, i.e., a spring 8 and a damper 9 as shown in FIG. 1, support the tub 10.

A drum 20 for holding a laundry and water therein is provided in the tub 10. A plurality of tumbling ribs 21 protrude from an inner circumference of the drum 20 and a multitude of perforated holes 25 penetrate into an outer circumference of the drum 20, whereby water supplied in the drum 20 is passed between the tub 10 and the drum 20 via the perforated holes 25.

An entrance 5 is provided at the cabinet cover 4 to put the laundry in/out of the drum 20. A door 6 is provided at the entrance 5 to open/close. And, a control panel 7 for controlling the washing machine is mounted over the cabinet cover 4.

A motor 15 is installed at a rear of the tub 10. A shaft of the motor 15, as shown in FIG. 1, penetrates into the tub 10 to be connected to the drum 20. Hence, once the motor 15 is driven, the drum 20 rotates in the tub 10. Meanwhile, the laundry is lifted up by the tumbling ribs 21 to fall down while the drum 20 rotates, by which frictional and shock energy is sufficiently provided for washing.

A drain assembly 17 and a water supply assembly 16 are provided in the cabinet 2. The water supply assembly 16 is provided over the tub 10 for supplying water and detergent to the tub 10. And, the drain assembly 17 is provided under the tub 10 for discharging water held in the tub 10 outside.

Meanwhile, at least one boss 11 is provided at an outside, i.e., rear outside, of the tub 10. The boss 11 is provided for fixing the tub 10 to the cabinet 2 to protect when the washing machine is carried. Once the boss 11 is provided, a bolt is externally inserted in the boss 11 through the cabinet 2, whereby the tub 10 is effectively prevented from being broken by the vibrations on carrying the washing machine.

Figure 2:
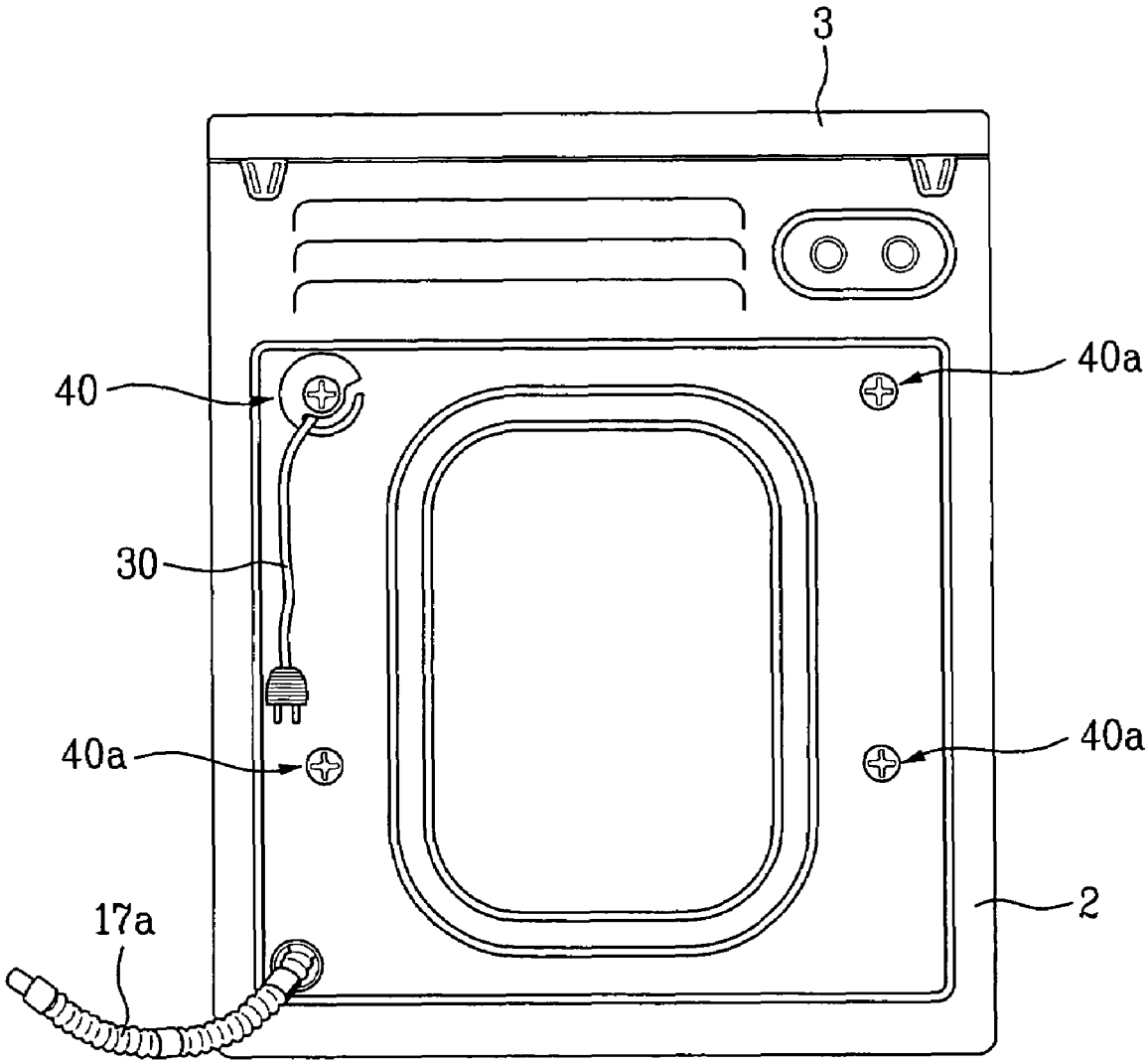
FIG. 2 is a rear view of the washing machine in FIG. 1, in which screwed protection bolts are shown.

FIG. 2 is a rear view of the washing machine in FIG. 1, in which screwed protection bolts are shown. Referring to FIG. 2, a drain hose 17*a* of the drain assembly 17 and a power cable 30 for supplying a power needed to operate the washing machine are drawn out. And, a plurality of bolts 40 and 40*a* for fixing the tub 10 to the cabinet 2 on carrying the washing machine penetrate into the cabinet 2 to be coupled with the corresponding bosses 11 in FIG. 1. The bolts 40 and 40*a*, as shown in FIG. 2, are coupled to the bosses 11 to use only when the washing machine is carried, but should be separated from the bosses 11 after the washing machine has been installed.

Figure 3:
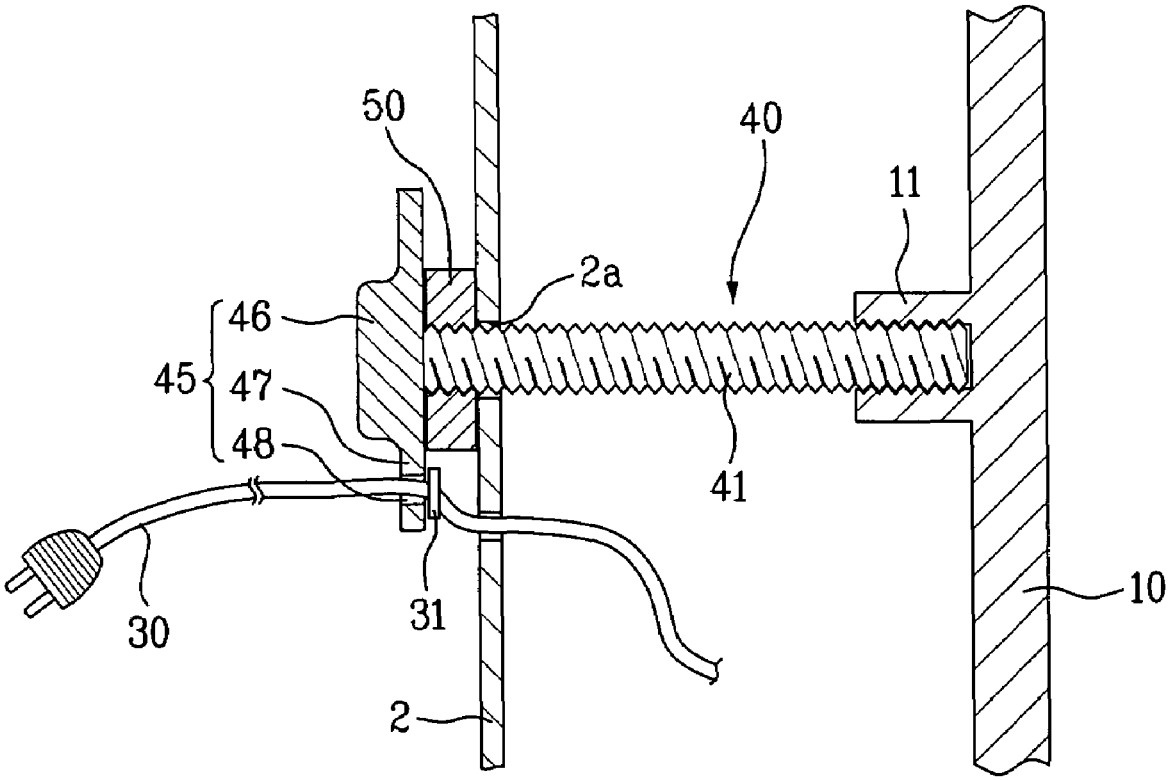
FIG. 3 is a cross-sectional view of a protection bolt coupled with a tub in the washing machine in FIG. 2.
Figure 4:
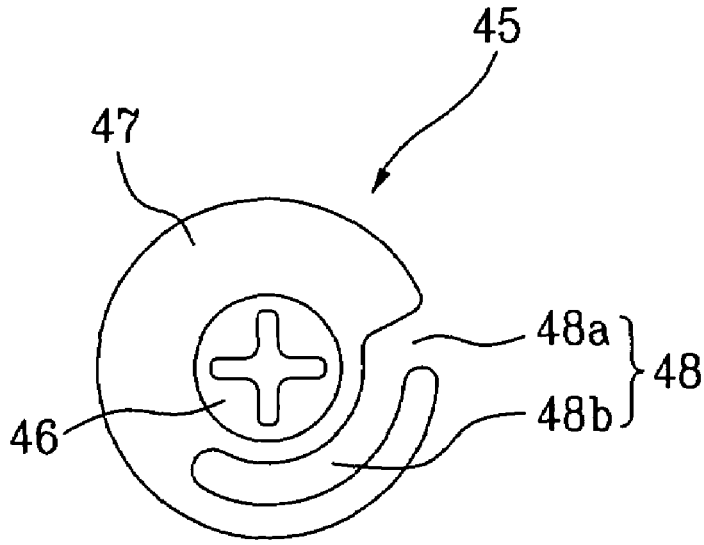
FIG. 4 is a front view of a head part of a protection bolt according to one embodiment of the present invention.
Figure 5:
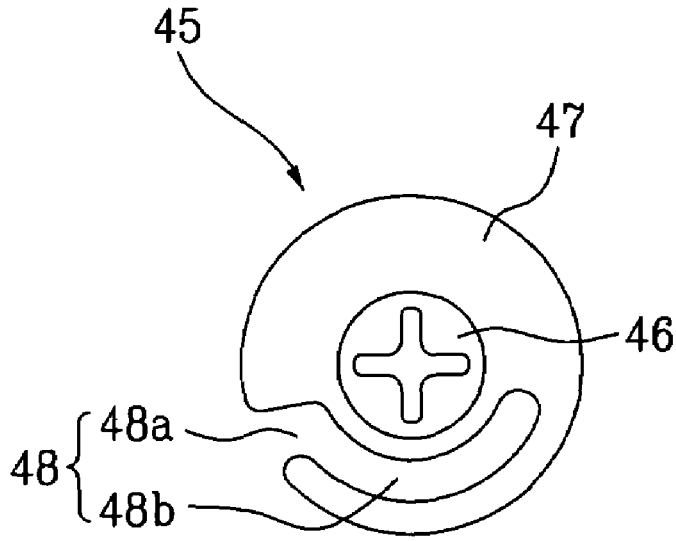
FIG. 5 is a front view of a head part of a protection bolt according to another embodiment of the present invention.

Meanwhile, the bolt 40 in the vicinity of the power cable 30 has a unique structure enabling it to hold the power cable 30. A structure of a tub protection bolt 40 according to the present invention is explained in detail by referring to FIG. 2 to FIG. 5 as follows. FIG. 3 is a cross-sectional view of a protection bolt coupled with a tub in the washing machine in FIG. 2, FIG. 4 is a front view of a head part of a protection bolt according to one embodiment of the present invention, and FIG. 5 is a front view of a head part of a protection bolt according to another embodiment of the present invention.

Referring to FIG. 3, a bolt 40 according to the present invention includes a screwed shaft 41 and a head part 45.

The screwed shaft 41, as shown in FIG. 2 and FIG. 3, penetrates into a rear side of the cabinet 2 and is then coupled to the boss 11 of the tub 10. For this, a hole 2*a*, as shown in FIG. 3, is provided on the rear side of the cabinet 2. The screwed shaft 41 penetrates into the hole 2*a*.

The head part 45, as shown in FIG. 3, is provided at one end of the screwed shaft 41, and is disposed at an outside of the rear side of the cabinet 2 when the screwed shaft 41 is coupled to the boss 11. In the bolt 40 according to the present invention, a narrow cut-away portion 48 is provided at the head part 45.

The power cable 30, as shown in FIG. 2 and FIG. 3, is inserted in the cut-away portion 48 to be held. Hence, even if a user pulls the power cable 30, it is unable to pull out the power cable 30 from the cabinet 2 since the cut-away portion 48 tightly holds the power cable 30.

Accordingly, if the cut-away portion 48 is provided at the head part 45, the user has difficulty in pulling out the power cable 30 from the cabinet 2 to connect to the electric outlet unless the bolt 40 is unscrewed after installation of the washing machine. Thus, the tub 10 is previously prevented from being broken by operating the washing machine while the tub 10 is fixed by the bolt 40.

Embodiments of the head part 45 playing the above-explained role are shown in FIG. 4 and FIG. 5. The structure of the head part 45 is described in detail by referring to FIG. 4 and FIG. 5 as follows.

Referring to FIG. 4 and FIG. 5, the head part 45 includes a head 46, a flange 47, and a cut-away portion 48.

The head 46 is provided at one end of the screwed shaft 41, and the flange 47 extends outward from an outer circumference of the head 46. And, the cut-away portion 48, as shown in FIG. 4, is formed narrow from a circumference of the flange 47 toward the head 46.

In this case, the cut-away portion, as shown in FIG. 4 and FIG. 5, includes an insertion portion 48*a* and a fixing portion 48*b*.

The insertion portion 48*a* is formed from the outer circumference of the flange 47 in a direction of a center of the head 46. The power cable 30 is pulled in through the insertion portion 48*a*. Hence, in the insertion portion 48*a*, as shown in FIG. 4 and FIG. 5, a circumference side of the flange 47 is preferably formed wider than an opposite side, i.e., a side adjacent to the head 46 so that the power cable 30 can be easily put in the insertion portion 48*a*.

Moreover, an outside corner of the flange 47 meting the insertion portion 48, as shown in FIG. 4 and FIG. 5, is preferably rounded. With such a structure, the power cable 30 can be prevented from being damaged by a sharp portion when being put in the insertion portion 48*a*.

The fixing portion 48*b*, as shown in FIG. 4 and FIG. 5, is bent from an end of the insertion portion 48*a*, and more specifically, from an end adjacent to the had 46. Thus, the power cable 30 having inserted in the fixing portion 48 is not easily pulled out externally. In the present invention, a connecting part between the insertion portion 48*a* and the fixing portion 4*b* is preferably formed round, whereby the power cable 30 inserted in the insertion portion 48*a* can be smoothly guided to the fixing portion 48*b*.

Meanwhile, the fixing portion 48*b* is preferably rounded along a direction of rotating the head part 45 when the screwed shaft 41 is fastened or unfastened. Hence, the fixing portion 48*b*, as shown in FIG. 4 and FIG. 5, is shaped like an arc shape having a predetermined length. Of course, a center of the arc is the same of the screwed shaft 41.

Specifically, the fixing portion 48*b* is preferably formed along a direction that the power cable 30 naturally moves toward the insertion portion 48*a* when the head 46 rotates in a direction of unscrewing the screwed shaft 41, which is explained in detail as follows.

First of all, it is assumed that the bolt 40 has a right-hand thread, which is screwed when rotating clockwise but unscrewed when rotating counterclockwise. And, it is also assumed that the fixing portion 48*b*, as shown in FIG. 5, is bent to the right from the insertion portion 48*a*.

In such a case, if the power cable 30 is inserted in the insertion portion 48*a* and the bolt 40 is screwed, the fixing portion 48*b* is turned clockwise as well as the head part 45. Hence, the power cable 30 effectively moves inside the fixing portion 48*b*.

If the screwed bolt 40 is unscrewed, the fixing portion 48*b* is turned counterclockwise together with the head part 45. Hence, the power cable 30 effectively moves toward the insertion portion 48*a*.

Meanwhile, it is assumed that the bolt 40 has a left-hand thread, which is screwed when rotating counterclockwise but unscrewed when rotating clockwise. And, it is also assumed that the fixing portion 48*b*, as shown in FIG. 5, is bent to the left from the insertion portion 48*a*.

In such a case, if the power cable 30 is inserted in the insertion portion 48*a* and the bolt 40 is screwed, the fixing portion 48*b* is turned counterclockwise as well as the head part 45. Hence, the power cable 30 effectively moves inside the fixing portion 48*b*.

If the screwed bolt 40 is unscrewed, the fixing portion 48*b* is turned clockwise together with the head part 45. Hence, the power cable 30 effectively moves toward the insertion portion 48*a*.

Thus, it is preferred that the fixing portion 48*b* is formed bent to the right from the insertion portion 48*a* if the bolt 40 has the right-hand thread. And, it is preferred that the fixing portion 48*b* is formed bent to the left from the insertion portion 48*a* if the bolt 40 has the left-hand thread.

Hence, the power cable 30 inserted in the insertion portion 48*a* naturally moves inside the fixing portion 48*b* when the bolt 40 is screwed. And, the power cable 30 inside the fixing portion 48*b* naturally moves toward the insertion portion 48*a* when the bolt 40 is unscrewed. Therefore, it is facilitated to put the power cable 30 in or out of the cut-away portion 48.

The forming direction of the fixing portion 48*b* is not limited to the above-described directions. Namely, if the fixing portion 48*b* is formed to have a direction opposite to the foregoing direction, it is able to insert the power cable 30 to fix. Hence, such a structure can be implemented as well.

Meanwhile, in the present invention, a washer 50, as shown in FIG. 3, can be further provided. The washer 50 has a predetermined thickness, and is provided between the head part 45 and the cabinet 2. The washer 50 partially encloses the screwed shaft 41 to prevent the power cable 30 from being damaged by the contact with the screwed shaft 41. And, the washer 50 prevents the bolt 40 from being unscrewed due to vibrations and the like as well.

In the present invention, the power cable 30 may include a protrusion 31. The protrusion 31 extends outward from a circumference of the power cable 30. The protrusion 31, as shown in FIG. 3, is arranged between the head part 45 and the cabinet 2 when the power cable 30 is inserted in the cut-away portion 48. When the power cable 30 is pulled out, the protrusion 31 is caught on the flange 47 to prevent the power cable 30 from being pulled out.

Meanwhile, the above-constructed tub protection bolt according to the present invention is installed before carrying the washing machine. For installation, the screwed shaft 41 is inserted in the hole 2*a* of the cabinet 2*a* to be coupled with the boss 11. When the bolt 40 is almost completed to be screwed, the power cable 30 pulled outside the cabinet 2 is inserted in the insertion portion 48*a* of the cut-away portion. In this case, the protrusion 31, as show in FIG. 3, is disposed between the head part 45 and the cabinet 2. If the bolt 40 is screwed under such a state, the fixing portion 48*b* rotates so that the power cable 30 moves inside the fixing portion 48*b*. In this case, the washer 50 prevents the power cable 30 from being damaged by the contact with the screwed shaft 41.

Once the bolt 40 is completely screwed, the rear side of the washing machine shows the view in FIG. 2. In this case, it is unnecessary to provide the cut-away portion to other bolts 40*a* except the bolt 40 holding the power cable 30. Meanwhile, when the washing machine is carried with the state of FIG. 2, the tub 10 fixed to the cabinet 2 by the bolt 40 is prevented from being broken by vibrations or shaking.

Meanwhile, after the washing machine has been installed, the power cable 30 is connected to the electric outlet to operate the washing machine. Since the power cable 30 is inserted in the cut-away portion 48 of the bolt 40, a length of the power cable 30 exposed outside the cabinet 2 is very short. A user then pulls out the power cable 30 to elongate and connects the power cable 30 to the electric outlet.

If the user pulls out the power cable 30 without unscrewing the bolt 40, the power cable 30 inserted in the cut-away portion 48 to be held is not pulled out. Hence, the user is unable to connect the power cable 30 to the electric outlet, thereby, failing to operate the washing machine. Therefore, the bolt 40 according to the present invention previously prevents the tub 10 from being broken as the washing machine operates while the tub 10 is fixed by the bolt 40.

Moreover, when the bolt 40 is unscrewed, the fixing portion 48*b* rotates so that the power cable 30 moves toward the insertion portion 48*a*. Under such a state, the power cable 30 is drawn outside the insertion portion 48*a*. The power cable 30 is then pulled out so as to be pulled from the cabinet 2. Hence, the exposed power cable 30 is sufficiently long. Therefore, the user connects the power cable 30 to the electric outlet to use the washing machine.

In using the washing machine, a laundry is put in the drum 20, the door is closed 6, and the control panel 7 is manipulated. The water supply assembly 16 then supplies water and detergent to the drum 20 appropriately. Once the drum 20 rotates, the laundry is repeatedly lifted up by the tumbling ribs 21 and to fall for washing.

After completion of washing, the drain assembly 17 discharges the used water of the drum and tub 20 and 10 outside. After completion of draining, the water supply assembly 16 supplies the drum 20 with water, the drum 20 then rotates to rinse the laundry. The drain assembly 17 then discharges the water used for rinsing outside. Such a rinsing step is performed at least once.

After completion of rinsing, the drum 20 rotates at high speed. A centrifugal force separates water contents from the laundry. After completion of dewatering, the user pulls out the washed and dewatered laundry via the door 6.

Moreover, if the washing machine is equipped with a drying function, hot air is supplied to the drum 20 to completely dry the laundry. The user then attains the completely washed and dried laundry.

Meanwhile, during the washing, rinsing, dewatering, and so on, massive vibrations are applied to the tub 10. The vibrations applied to the tub 10 are attenuated by the springs 8 and dampers 9 so as not to be externally transferred.

Accordingly, the washing machine according to the present invention has the following advantages or effects.

First of all, the cut-away portion is provided to the protection bolt temporarily fixing the tub to the cabinet, whereby the power cable can be fixed. Hence, a user is unable to connect the power cable to the electric outlet without unscrewing the bolt. Therefore, the tub is previously prevented from being damaged as the washing machine is driven while the tub is fixed to the cabinet.

Secondly, the fixing portion of the cut-away portion is bent to the right or left from the insertion portion so that the power cable inserted in the fixing portion is hardly separated. Moreover, since the fixing portion rotates when the bolt is screwed or unscrewed, the power cable is easily inserted in or separated from the cut-away portion.

Thirdly, if the washer is provided, it is able to prevent the power cable from being damaged by the contact with the screwed shaft when the bolt is screwed/unscrewed or the washing machine is carried.

Finally, if the protrusion is provided, the power cable is prevented from being drawn outside more effectively.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A tub protection bolt for a washing machine, comprising:

a screwed shaft configured to penetrate a cabinet of the washing machine to be coupled with a boss of a tub; and a head part at one end of the screwed shaft having a narrow cut-away portion configured to hold a power cable of the washing machine, the head part comprising:

a head at the one end of the screwed shaft; and a substantially planar flange that extends outward from an outer circumference of the head, wherein the narrow cut-away portion extends from an outer circumference of the flange in toward the head.

2. The tub protection bolt as claimed in claim 1, the cut-away portion comprising:

an insertion portion provided from the outer circumference of the flange in a direction of a center of the head; and a fixing portion bent from an end of the insertion portion.

3. The tub protection bolt as claimed in claim 2, wherein an outer circumference side of the insertion portion is formed wider than an opposite side of the insertion portion adjacent the head.

4. The tub protection bolt as claimed in claim 2, wherein an outside corner of the flange meeting the insertion portion is rounded.

5. The tub protection bolt as claimed in claim 2, wherein the fixing portion is formed rounded along a direction of rotating the head part when the screwed shaft is screwed or unscrewed.

6. The tub protection bolt as claimed in claim 2, wherein the fixing portion is formed along a direction that the power cable inserted in the fixing portion naturally moves toward the insertion portion when the head rotates in a direction of unscrewing the screwed shaft.

7. The tub protection bolt as claimed in claim 1, further comprising a washer provided between the head part and the cabinet having a predetermined thickness.

8. The tub protection bolt as claimed in claim 1, wherein the power cable includes a protrusion extending an outer circumference of the power cable to lie between the head part and the cabinet when the power cable is inserted in the cut-away portion.

9. A washing machine, comprising:

a cabinet;

a tub in the cabinet having at least one boss protruding from an outside of the tub;

a protection bolt comprising:

a screwed shaft configured to penetrate the cabinet to be coupled with the at least one boss of the tub; and a head part at one end of the screwed shaft having a narrow cut-away portion configured to hold a power cable, wherein the head part comprises:

a head at the one end of the screwed shaft; and a substantially planar flange that extends outward from an outer circumference of the head, wherein the narrow cut-away portion extends from an outer circumference of the flange in toward the head;

at least one elastic member suspending the tub in the cabinet; and a drum rotatably installed in the tub.

10. The washing machine as claimed in claim 9, the cut-away portion comprising:

an insertion portion provided from the outer circumference of the flange in a direction of a center of the head; and a fixing portion bent from an end of the insertion portion.

11. The washing machine as claimed in claim 10, wherein an outer circumference side of the flange contouring the insertion portion is wider than an opposite side.

12. The washing machine as claimed in claim 10, wherein an outside corner of the flange meeting the insertion portion is rounded.

13. The washing machine as claimed in claim 10, wherein the fixing portion is formed rounded along a direction of rotating the head part when the screwed shaft is screwed or unscrewed.

14. The washing machine as claimed in claim 10, wherein the fixing portion is formed along a direction that the power cable inserted in the fixing portion naturally moves toward the insertion portion when the head rotates in a direction of unscrewing the screwed shaft.

15. The washing machine as claimed in claim 9, further comprising a washer provided between the head part and the cabinet having a predetermined thickness.

16. The washing machine as claimed in claim 9, wherein the power cable includes a protrusion extending around an outer circumference of the power cable and configured to lie between the head part and the cabinet when the power cable is inserted into the cut-away portion.

* * * * *